United States Patent [19]

Drummond et al.

[11] 4,077,782

[45] Mar. 7, 1978

[54] COLLECTOR FOR ELECTROSTATIC PRECIPITATOR APPARATUS

[75] Inventors: James E. Drummond, Coronado; Alfred A. Mondelli, Del Mar; Alan C. Kolb, Solana Beach, all of Calif.

[73] Assignee: Maxwell Laboratories, Inc., San Diego, Calif.

[21] Appl. No.: 730,026

[22] Filed: Oct. 6, 1976

[51] Int. Cl.[2] ..... B03C 3/45

[52] U.S. Cl. ..... 55/139; 55/155

[58] Field of Search ..... 55/129, 130, 146, 155, 55/157, 136, 139; 252/64; 361/126, 230

[56] References Cited

U.S. PATENT DOCUMENTS

| | | | |
|---|---|---|---|
| 1,541,677 | 6/1925 | Anderson | 55/155 |
| 1,943,070 | 1/1934 | Grave | 55/130 |
| 2,351,089 | 6/1944 | Abbey | 55/155 |
| 2,535,697 | 12/1950 | Roos | 55/155 |
| 2,978,066 | 4/1961 | Nodolf | 55/155 |
| 3,417,302 | 12/1968 | Lueder | 55/139 |
| 3,487,610 | 1/1970 | Brown et al. | 55/155 |
| 3,650,092 | 3/1972 | Goordine et al. | 55/146 |
| 3,898,468 | 8/1975 | Guerin | 55/139 |
| 3,918,939 | 11/1975 | Hardt | 55/155 |
| 3,977,848 | 8/1976 | Oliphant | 55/139 |

FOREIGN PATENT DOCUMENTS

| | | | |
|---|---|---|---|
| 288,208 | 7/1929 | United Kingdom | 55/157 |

OTHER PUBLICATIONS

Hawley, Gessner; The Condensed Chemical Dictionary; Eighth Edition; Van Nostrand Reinhold Company; p. 956.

*Primary Examiner*—Frank W. Lutter
*Assistant Examiner*—David L. Lacey
*Attorney, Agent, or Firm*—Fitch, Even, Tabin & Luedeka

[57] ABSTRACT

An improved collector structure is disclosed which is adapted for use in electrostatic precipitators to increase the efficiency of operation by increasing the electric field uniformity in the device and by reducing the power consumption without appreciably increasing reentrainment of the precipitated particles during operation. The collector is provided with an insulating material of the type which has an electrical relaxation time, $\rho\epsilon$, that is preferably greater than that associated with the particle current in the gas near the collector electrode, a triboelectric rank that is as low as possible if the collector electrode is negatively charged or as high as possible if the collector electrode is positively charged with respect to the opposite electrode and a thickness and resistivity such that the voltage drop across the insulation does not exceed about 5 to 10% of the applied voltage between the oppositely charged electrodes of the precipitator. A modification of the apparatus includes a mesh or screen grid structure attached to the exposed surface of the insulation.

31 Claims, 4 Drawing Figures

Fig. 1.
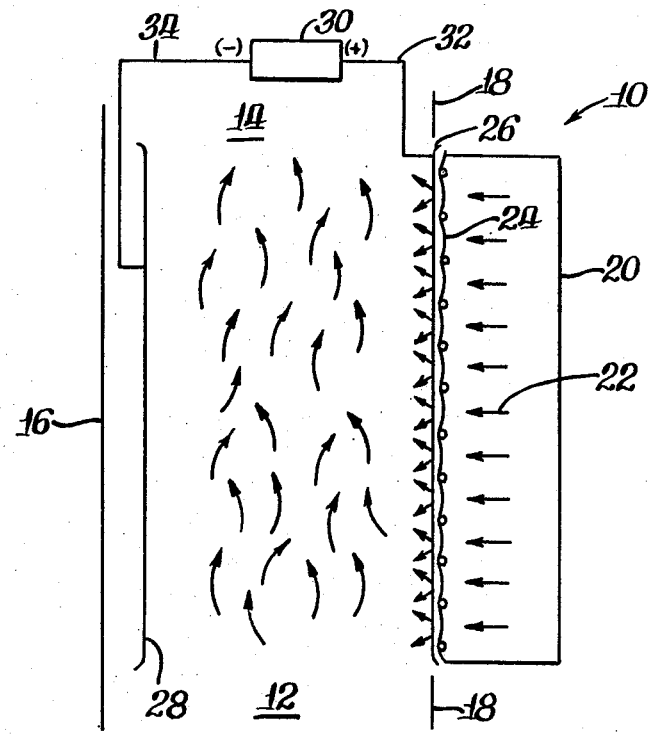
Fig. 2.
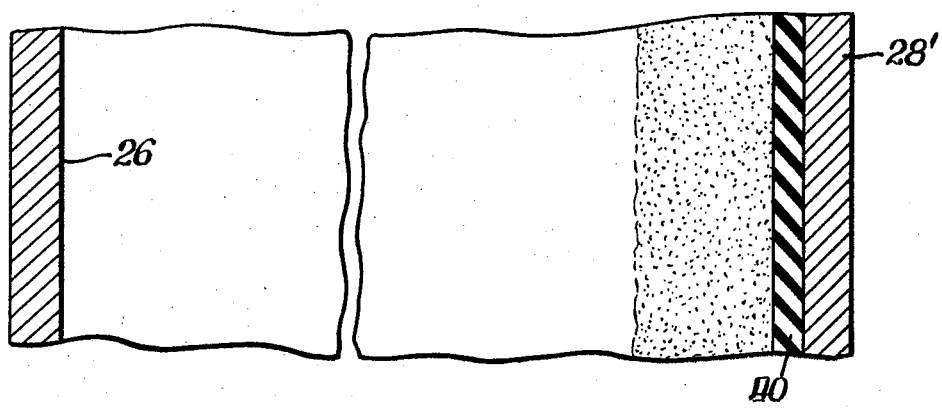
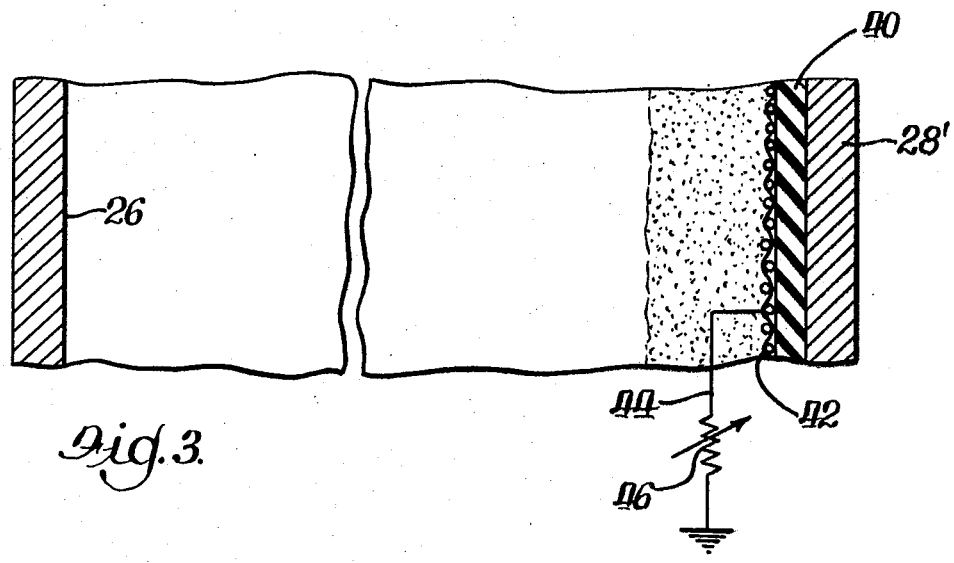
Fig. 3.

COLLECTOR FOR ELECTROSTATIC PRECIPITATOR APPARATUS

The present invention generally relates to electrostatic precipitators and, more specifically, to an improved collector structure for use in electrostatic precipitators.

Conventional prior art electrostatic precipitating apparatus as well as the improved electrostatic precipitation apparatus disclosed and claimed in patent applications, Ser. No. 602,730, filed Aug. 7, 1975 and Ser. No. 603,157, filed Aug. 8, 1975, of Alan C. Kolb and James E. Drummond both applications of which are assigned to the same assignee as the present invention, experience a phenomena during their operation whereby the dust particles that have been precipitated out or collected on the collecting electrode may be reintroduced into the fluid flow if the charge on the collecting electrode is not sufficient to maintain the dust particles thereon. This reintroducing of dust particles into the fluid flow, often referred to as reentrainment, occurs in part because the charged dust particles gradually lose their charge when they land on the collector surface and can even acquire a reverse charge relative to the collector. Such reverse charge in the electric field of the precipitator acts to pull the particle off of the surface. It is usually not large enough to break the Van der Waals force holding the particle to the wall except at sharp peaks where the electric field concentrates. At these points the force per unit charge increases and, accordingly, charges are pulled to these points so that the total force on a point is proportional to the square of the field. As a result, very small particles resting on top of medium size particles (which in turn rest upon the top of large particles) experience the largest force per unit area. The exposed points tend to grow quickly because the field concentration precipitates particles at the fastest rate at such promontories. This phenomena limits the ultimate collection efficiency that is experienced.

One prior solution to this problem has been provided by bathing the collector with a continuous source of ions. This current is thereby used to continually recharge the precipitated dust particles located on the collector. Typically, in conventional prior art electrostatic precipitators as much as 50 times as much current is needed to recharge the precipitated dust particles as was originally needed to charge the dust particles. It should be quite apparent that much of the energy required to operate conventional electrostatic precipitators involves the energy in keeping the dust particles on the collector rather than initially collecting them and the operating efficiency of such units would be greatly increased if some mechanism were found to reduce the current that is required to hold the particles to the collector.

Accordingly, it is an object of the present invention to provide an improved collector construction which exhibits substantially improved operating efficiency. The improved operating efficiency is exhibited by the substantially lower operating current that is required to prohibit reentrainment compared to conventional electrostatic precipitators.

A significant advantage associated with the lower operating current in the present invention is the greater electric field uniformly which can be tolerated. Conventional prior art electrostatic precipitators rely on a corona discharge to generate the required ion current. The corona discharge, in turn, depends on significant non-uniformity in the electric field in order that the discharge be confined to a small volume near one of the electrodes. The greater electric field uniformity in the present invention allows operation at higher values of the average electric field strength than can be obtained in conventional electrostatic precipitators without experiencing electric breakdown or arcing. The particle collection efficiency will therefore be higher in the present invention than in conventional electrostatic precipitators.

Other objects and advantages will become apparent upon reading the following detailed description, in conjunction with the attached drawings, in which:

FIG. 2 is a fragmentary diagrammatic representation of a precipitating apparatus illustrating one form of the collector construction embodying the present invention;

FIG. 3 is a fragmentary diagrammatic representation of precipitating apparatus embodying another embodiment of the improved collector construction embodying the present invention; and, FIG. 4 is a graph of the triboelectric rank versus dielectric constant of insulators and work function of conductors.

Figure 1:
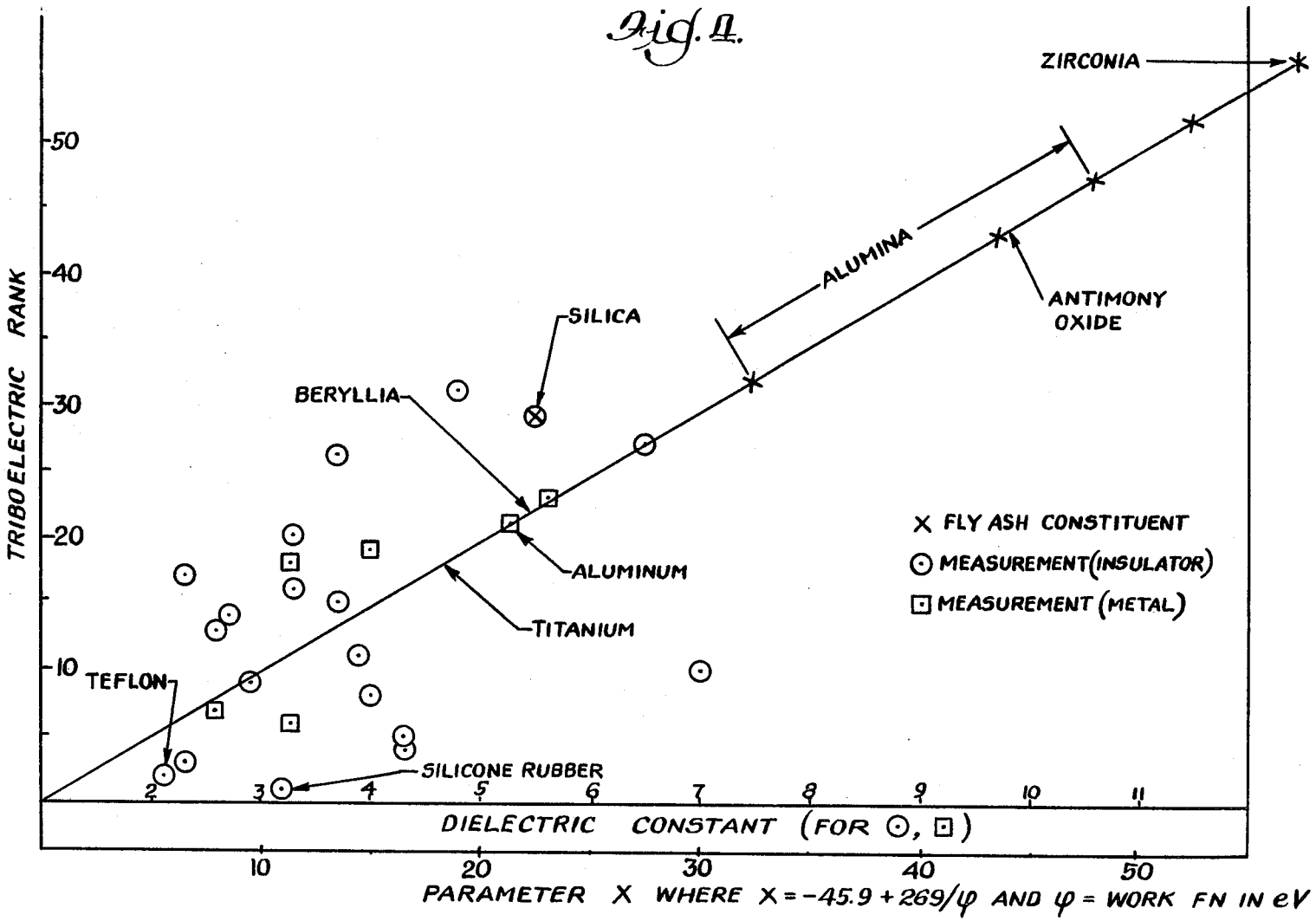
FIG. 1 is a diagrammatic representation of one form of precipitating apparatus which may be used with the improved collector construction embodying the present invention.

Broadly stated, the present invention is directed to an improved collector construction for use in an electrostatic precipitator of the type that utilizes a positively charged collecting surface as in most conventional prior art electrostatic precipitators, or a negatively charged collecting surface, such as is disclosed in the Kolb and Drummond application, Ser. No. 602,730, assigned to the same assignee as the present invention. The improved collector construction involved coating the exposed surface with an insulating material that is chosen so as to exhibit unique characteristics as will be hereinafter discussed in detail. The insulating material has the effect of reducing the amount of current that is required to reduce the reverse charging phenomena that is generally experienced. By reducing the amount of current that is required to inhibit the dust particles from being reentrained, the cost of operation is significantly reduced. The insulating coating that is applied to the collecting surface can enhance the operating efficiency of the precipitating apparatus, regardless of the geometrical design of the apparatus. Depending upon the specific material that is utilized, the collector construction embodying the present invention may require the use of a wire screen or mesh layer attached to the exposed surface of the insulation to facilitate collection of dust particles, all of which will be described in detail hereinafter.

Broadly stated, the insulating material should have an electrical relaxation time, $\rho\epsilon$, which is greater than that associated with the particle current in the flue gas near the collector electrode. The electrical relaxation time of the insulating material is defined as the product of the electrical resistivity, $\rho$, of the insulation and the permittivity, $\epsilon$, of the insulation. The electrical relaxation time associated with the particle current in the gas near the collector electrode is likewise defined as the product of resistivity and permittivity, $\rho\epsilon$, where the resistivity is given by the quotient of the electric field strength in the gas near the surface of the dust layer with the electrical current density carried by the charged dust particles and any ions in the gas near the surface of the dust layer, and the permittivity is that associated with the dust-laden medium. Also, the triboelectric rank of the insulating material should be as low as possible for collecting positively charged particles and as high as possible for collecting negatively charged particles and in any case respectively lower than the triboelectric rank of positive dust particles being collected or higher than the triboelectric rank of negative particles being collected. The product of resistivity and thickness of the insulating layer should be sufficiently small that a relatively insignificant fraction of the voltage drop between the electrodes of the apparatus occurs across the insulating layer itself. In this regard only about 5 to 10 percent of the voltage drop should occur in the insulating material itself and, where the voltage drop is significantly greater, the use of the wire mesh or screen in conjunction with the insulating layer is preferred in order to control the voltage drop across the insulation.

With respect to these general considerations and specifically the consideration regarding the triboelectric rank of the insulating material, it should be appreciated that whenever dissimilar materials come into close contact, a transfer of electrons takes place between them. For example, if an isolated piece of metal is emersed in a thermoplasma of temperature, T, electrons that strike the metal are captured by it because they either quickly share the work function which they gain in entering among many neighboring electrons or they radiate phonons. Thus, the metal acquires a charge until it is so negative that it repels most of the electrons, accepting electrons only at the rate at which positive ions strike the metal. This is often referred to as the contact difference in potential and is about $kT/e$ in magnitude, where $k$ is Boltzmann's constant and $e$ is the magnitude of the electronic charge. If the metal is thereafter removed from the plasma, the charge it retains is regarded as its triboelectric charge. The metal would be negative and the plasma positive so that the plasma would be regarded as having a high "rank" in the triboelectric series. If the metal is hot enough to emit some electrons, its contact difference of potential and triboelectric charge would become smaller in magnitude. Metals of low work function emit electrons rapidly and thus are less negative in a plasma than metals of high work function. Accordingly, metals of high work function generally have low triboelectric rank, i.e., they become more negative, while low work functions generally imply high rank, i.e., less negative charge retention. It should be understood, however, that the work function of a metal also depends upon surface impurities and irregularities as well as upon the crystal face exposed so that the triboelectric rank is not always uniquely determined by specifying only the nominal bulk material composition. It is because of these considerations that the triboelectric series details vary from source to source, even through the gross features are consistent.

Insulating materials are also known to exchange charge upon coming into intimate contact. The dielectric constant is a measure of the ease with which charge dipoles may arise and/or be moved within an insulator so that it correlates with the ease with which electrons can be removed from insulator surfaces. High dielectric constants generally correspond to the low work function in metals and a low dielectric constant generally corresponds to a high work function in metals. In this manner, insulators of high dielectric constant also tend to have high triboelectric rank.

In the context of the present invention, the insulating material that is applied to the collector should be as low as possible in the triboelectric ranking or series and must be lower than the triboelectric rank of the dust particles that are to be removed when the dust is positively charged. Conversely, the insulating material should be as high as possible in the triboelectric series and must be of higher rank than the dust being collected when the dust is negative. Some insulating materials are shown in Table I together with their triboelectric rank relative to one another as well as their respective dielectric constants. As is shown in the table, polytetrafluoroethylene and silicone rubber have the lowest ranking in the triboelectric series illustrated and they have relatively low dielectric constants as well. Thus, using the triboelectric ranking criterion, the polytetrafluoroethylene and silicone rubber are desirable materials for use on a collector of positive particles. While asbestos is suggested by Table I for use in the collection of negative particles, the correlation between triboelectric rank and dielectric constant, shown in FIG. 4, suggests that Zirconia, $ZrO_2$, would be superior.

TABLE I

| Material | Triboelectric Rank | Dielectric Constant or (work function) | Resistivity at Temperature [Ω-cm] | [° C] | Relaxation Time [sec] |
|---|---|---|---|---|---|
| Asbestos | 31 | 4.8 | | | |
| Rabbit's Fur | 30 | | | | |
| Glass | 29 | 5.5 | $7 \times 10^7$ | 250 | $3.4 \times 10^{-5}$ |
| Human Hair | 28 | | | | |
| Mica | 27 | 6.5 | $1.6 \times 10^8$ | 200 | $9.2 \times 10^{-5}$ |
| Nylon | 26 | 3.7 | $8 \times 10^{12}$ | 80 | 2.6 |
| Wool | 25 | | | | |
| Cat's Fur | 24 | | | | |
| Lead | 23 | (3.9 eV) | $3.8 \times 10^{-5}$ | 200 | |
| Silk | 22 | | | | |
| Aluminum | 21 | (4 eV) | $5.7 \times 10^{-6}$ | 200 | |
| Paper | 20 | 3.3 | $10^{14}$ | 20 | 29.0 |
| Cotton | 19 | 4.0 | | | |
| Steel | 18 | (4.7 eV) | $2.6 \times 10^{-5}$ | 200 | |
| Wood | 17 | 2.3 | | | |
| Lucite | 16 | 3.3 | | | |
| Sealing Wax | 15 | 3.7 | $5 \times 10^{12}$ | 100 | 1.6 |
| Amber | 14 | 2.7 | | | |
| Polystyrene | 13 | 2.6 | $10^{16}$ | 75 | 23.0 |
| Rubber Balloon | 12 | | $3 \times 10^{11}$ | 200 | |
| Sulfur | 11 | 3.9 | | | |
| Cellulos Nitrate | 10 | 7.0 | $3 \times 10^{10}$ | 25 | $1.9 \times 10^{-2}$ |
| Hard Rubber | 9 | 2.9 | $3 \times 10^{11}$ | 200 | $7.7 \times 10^{-2}$ |
| Acetate Rayon | 8 | 4.0 | | | |
| Nickel-Copper | 7 | (5 eV) | | | |

TABLE I-continued

| Material | Triboelectric Rank | Dielectric Constant or (work function) | Resistivity at Temperature [Ω-cm] | [° C] | Relaxation Time [sec] |
|---|---|---|---|---|---|
| Brass-Silver | 6 | (4.7 eV) | | | |
| Orlon | 5 | 4.3 | | | |
| saran | 4 | 4.3 | $3 \times 10^{14}$ | 25 | 110.0 |
| Polyethylene | 3 | 2.3 | $10^{16}$ | 130 | $2 \times 10^{3}$ |
| Polytetrafluoro-ethylene | 2 | 2.1 | $1.4 \times 10^{18}$ | 25 | $2.6 \times 10^{5}$ |
| Silicone Rubber | 1 | 3.2 | $3 \times 10^{13}$ | 25 | 850.0 |

In accordance with another aspect of the present invention, the relaxation time, $\rho\epsilon$, of the insulating material should preferably be greater than that associated with the particle current near the collector electrode to ensure that the net charge on the collected dust layer has an electrical polarity such that the electric field in the apparatus will hold the dust layer onto the collector electrode. Also, the resistivity and thickness of the insulating layer must not be so high that more than about 10% of the voltage drop occurs across the insulation layer itself. In this regard, if the resistivity of the insulation is exceedingly high, the voltage drop will occur substantially across the insulation itself and very little electric field would be present in the gap or space through which the particle-laden gas is driven. If the electric field in the gap is substantially reduced, the particles will not be efficiently collected on the collector and very little accumulation of dust particles will be experienced. In addition to the resistivity of the insulation material, the thickness of the insulating layer is also important with regard to the amount of voltage drop that occurs across the insulation itself. Thus, the resistivity and thickness of the insulation are interrelated and both of these factors should not create a voltage drop across the insulation layer that is in excess of about 10% of the applied voltage between the two electrodes. Moreover, it is preferable that the voltage drop not exceed about 5 to 10% of the applied voltage between the anode and the negatively charged collector.

If the insulator material that is applied to a negatively charged collector is either polytetrafluoroethylene or silicone rubber, which are the two lowest ranking in the triboelectric series of those insulators listed in Table I are used, the resistivity of both of these materials is sufficiently high at low temperatures such that most of the voltage drop may occur across the insulation material itself for moderate thicknesses. If much of the voltage drop is across the insulation, little collection of the dust particles occurs. For this reason, a grid structure is preferably applied to the exposed surface of the insulation material and the voltage on the grid carefully tuned so that the voltage drop is across the air gap rather than across the insulation material. When silicone rubber is used as the insulating material and when the temperature of the gaseous medium passing through the apparatus is between about 250° to about 350° F, the resistivity of the insulation drops to a value such that the grid structure is not always necessary.

Turning now to the drawings and particularly FIG. 1, there is shown a precipitating apparatus of the type disclosed in Kolb et al. application Ser. No. 602,730 which, as is described therein, comprises apparatus, indicated generally at 10, which communicates the gaseous medium from a lower inlet 12 to the outlet 14 in an upward direction as shown by the arrows. Sidewalls 16 and 18 direct the flow of the gaseous medium through the apparatus. An electron generating source 20 is positioned within an opening in the sidewalls 18 and generates high energy electrons schematically illustrated by the arrows 22 which penetrate a thin transmission window 24 and a positively charged anode 26 into the gaseous medium. A negatively charged collector 28 is positioned adjacent the sidewall 16 so that an electric field is set up between the anode and collector across the channel width as shown. The anode 26 and collector 28 are charged by source 30 having a positive terminal connected to the anode through line 32 and its negative terminal connected to the collector 28 through line 34. The curved arrows within the channel or area inside the inlet and outlet of the apparatus are intended to depict some turbulence or large scale mixing of the particles as the effluent or gaseous medium passes through the apparatus. The mixing action insures that very few particles will remain for any length of time in the region close to the positively charged electrode 26 which contains ions of both signs. While the electrodes 26 and 28 are shown to be generally flat planar members having arcuate edges, the collector construction of the present invention is applicable to not only the flat planar construction but to other geometric configurations that may be utilized. As is fully described therein, the flat planar configuration is believed to offer desirable operational advantages for the reason that electric field maxima are minimized, i.e., the average field strength approaches the maximum field strength within the apparatus with this flat construction. Stated in other words, the flat construction enables a more uniform electric field to be established without experiencing electric breakdown or arcing.

Turning to the diagrammatic representation of FIG. 2, the collector 28' is shown to have a layer of insulating material 40 bonded thereto. The layer preferably has a thickness of about 1/32 inch to about 1/16 inch, since this range for most materials described herein is consistent with the voltage drop limit as has been previously described. If it is bonded with an adhesive or the like, the adhesive or bonding agent must be compatible with the insulating material and be capable of providing a suitable bond between the insulating material 40 and the metallic collector 28 so that the insulating material will not separate from the collector. In this regard, if the electrostatic precipitator is placed in an environment wherein the gaseous medium is flue gas or other industrial effluent, the temperature of the gas may reach several hundred degrees and the bonding agent should not deteriorate at such temperatures. Moreover such effluents present an extremely harsh chemical environment and the bonding agent must be capable of withstanding such a corrosive environment over an extended period of time wherever unprotected by the insulating layer such as silicone rubber, which is chemically resistive to attack. It is also possible that both silicone rubber and polytetrafluoroethylene can be directly applied to a collector surface in particle or liquid form, and be thereafter polymerized or cured so that the material itself forms a bond with the metallic collector, rather than being preformed in a sheet and thereafter bonded to the collector.

Referring to the modification of the collector structure also embodying the present invention and illustrated in FIG. 3, a grid structure 42 is shown to overlie the layer of insulating material 40, with the grid structure 42 preferably comprising a metal screen or mesh (such as bronze or copper) suitably attached by a cement, adhesive or the like. The screen or mesh may be a 1/16 inch square mesh construction or comprised of foil strips. The screen or mesh construction is preferred because of the inherent mechanical strength that results from the interweaving of the wires that make up the mesh or screen. The grid 42 is connected to ground through line 44 and variable resistance 46 which may be adjusted to control the magnitude of the surface charge layer in the dust that is collected. If the adjusted resistance is too large, the collection of the dust on the grid structure will be impeded because the electric field will be removed from the space or gap. If the resistance is too small, the dust particles that are collected will not acquire the necessary positive charge layer which holds the layer on the collector. The variable resistor should preferably be adjusted so that the grid voltage is held to a relatively low level, i.e., about 1000 volts, plus or minus about 200 volts and a resistance of about $10^9$ ohms was found to be appropriate for 3 square feet of collector. When silicone rubber is used as the insulating layer and the grid voltage maintained at the approximate 1000 volt level, no evidence of reentrainment was seen until the voltage in the apparatus approached 14 kV/cm at the surface of the dust layer when the volume flow rate through the space was at about 12 CFM.

It should be appreciated that the grid 42 may only be required where the insulating material 40 has an extremely high resistivity so that initial collection of the dust particles is impeded. In the event silicone rubber or polytetrafluoroethylene is used as the insulating material and the ambient temperature of the gaseous medium flowing through the precipitating apparatus is less then about 40° C, the grid structure may be necessary. However, in the event the precipitating apparatus is used for removing particles from an effluent from a furnace, flue or other exhaust that is of a high temperature, the grid structure may not be necessary for the reason that many insulating materials experience a reduction in their resistivity upon an increase in temperature. In this regard, when silicone rubber is used for the insulating layer 40 and the temperature of the gaseous medium passing through the apparatus is about 250° to about 350° F, the resistivity drops to a level whereby the grid structure may not be required.

From the foregoing description, it should be appreciated that a collector construction has been described which offers significantly improved operating efficiency in terms of the energy that is required to maintain precipitated particles on the collector structure without experiencing appreciable reentrainment. The structure incorporates an insulating material that greatly increases the time required for electrons to reverse charge the dust particles located on the collector. By using an insulating material that has a low triboelectric rank and a resistivity value that is within the desired range, collection of the dust particles in relatively thick layer can be achieved without requiring significantly high current flow to maintain the particles thereon and this can occur in extremely high electric fields, i.e., up to the breakdown field level. In certain applications a grid structure may be necessary to compensate for resistivity values that may effectively preclude efficient collection of the particles on the collector.

While particular embodiments of the present invention have been illustrated and described, various modifications, substitutions and alternatives will be apparent to those skilled in the art, and, accordingly, the scope of the present invention should be defined only by the appended claims and equivalents thereof.

Various features of the invention are set forth in the following claims.

What is claimed is:

1. In an electrostatic precipitator having oppositely charged electrodes and a particle collecting electrode structure that is negatively charged, the improvement comprising:

the collector structure comprised of an electrically conductive metallic material, said collector structure being positioned within said precipitator and adapted to have dust particles attracted to and being accumulated thereon;

a layer of insulating material attached to and covering a substantial length of the surface of said collector structure, said insulating material having a low triboelectric rank that is preferably lower than the triboelectric rank of the dust particles to be collected, the relaxation time of said insulating material being greater than the relaxation time of the space near the collector structure and the product of resistivity and thickness of said insulation not exceeding a value whereby the voltage drop across the insulating material exceeds about 10% of the applied voltage between the oppositely charged electrodes of said precipitator, the respective relaxation times of said insulating material and of space being the product of the electrical resistivity and the permittivity thereof.

2. An electrostatic precipitator as defined in claim 1 wherein said insulating material is polytetralfuoroethylene.

3. An electrostatic precipitator as defined in claim 2 wherein said material has a thickness of about 1/32 inch to about 1/16 inch.

4. An electrostatic precipitator as defined in claim 1 wherein said insulating material comprises silicone rubber.

5. An electrostatic precipitator as defined in claim 4 wherein said material has a thickness of about 1/32 inch to about 1/16 inch.

6. An electrostatic precipitator as defined in claim 1 including a grid structure attached in an overlying position to said insulating material and means for controlling the voltage level of said grid structure.

7. An electrostatic precipitator as defined in claim 6 wherein said grid structure comprises a bronze screen.

8. An electrostatic precipitate as defined in claim 6 wherein said grid structure comprises a copper screen.

9. An electrostatic precipitate as defined in claim 6 wherein said means for controlling said potential comprises a variable resistor interconnected between said grid and ground potential connection.

10. In an electrostatic precipitator having oppositely charged electrodes and a particle collecting electrode structure that is positively charged, the improvement comprising:

the collector structure being comprised of an electrically conductive metallic material, said collector structure being positioned within said precipitator and adapted to have dust particles attracted to and be accumulated thereon;

a layer of insulating material attached to and covering a substantial length of the surface of said collector structure, said insulating material having a high triboelectric rank that is preferably higher than the triboelectric rank of the dust particles to be collected, the relaxation time of said insulating material being greater than the relaxation time of the space near the collector structure and the product of resistivity and thickness of said insulation not exceeding a value whereby the voltage drop across the insulating material exceeds about 10% of the applied voltage between the oppositely charged electrodes of said precipitator, the respective relaxation times of said insulating material and of space being the product of the electrical resistivity and permittivity thereof.

11. An electrostatic precipitate as defined in claim 10 wherein said insulating material is Zirconia.

12. An electrostatic precipitator as defined in claim 11 wherein said material has a thickness of about 1/32 inch to about 1/16 inch.

13. An electrostatic precipitator as defined in claim 10 including a grid structure attached in an overlying position to said insulating material and means for controlling the voltage level of said grid structure.

14. An electrostatic precipitator as defined in claim 13 wherein said grid structure comprises a bronze screen.

15. An electrostatic precipitator as defined in claim 13 wherein said grid structure comprises a copper screen.

16. An electrostatic precipitator as defined in claim 13 wherein said means for controlling said potential comprises a variable resistor interconnected between said grid and ground potential connection.

17. Apparatus for removing the particles from a gaseous medium passing therethrough, comprising:

an inlet for receiving and an outlet for expelling the medium;

a central portion between said inlet and outlet for guiding said medium through the apparatus;

one or more positively charged electrodes located in said central portion;

one or more negatively charged collector electrodes located in said central portion for attracting particles having a net positive charge from the medium;

an energy source means connected to said positive charged electrodes for producing a supply of positive ions which bombard particles and cause, the particles to be attracted to the negatively charged collector electrodes.

each of said collector electrodes having a layer of insulation material attached to and covering a substantial length of said collector electrods and which has a triboelectric ranking that is less than the dust particles which are to be collected, said collector structure insulation layer having an electrical relaxation time that is greater than the relaxation time of the space near the collector electrodes, and the product of resistivity and thickness of said insulation not exceeding a value whereby the voltage drop across the insulating material exceeds about 10% of the applied voltage between the oppositely charged electrodes of said apparatus, the respective relaxation times of said insulating material and of space being the product of the electrical resistivity and permittivity thereof.

18. Apparatus as defined in claim 17 wherein said layer has a thickness within the range of about 1/32 inch to about 1/16 inch.

19. Apparatus as defined in claim 18 wherein said layer of insulated material comprises polytetrafluoroethylene.

20. Apparatus as defined in claim 18 wherein said layer of insulated material comprises silicone rubber.

21. Apparatus as defined in claim 17 including a grid structure attached to an overlying position to said insulating material and means for controlling the voltage level of said grid structure.

22. Apparatus as defined in claim 21 wherein said grid structure comprises a bronze screen.

23. Apparatus as defined in claim 21 wherein said grid structure comprises a copper screen.

24. Apparatus as defined in claim 21 wherein said means for controlling said potential comprises a variable resistor interconnected between said grid and ground potential connection.

25. Apparatus for removing the particles from a gaseous medium passing therethrough, comprising:

an inlet for receiving and an outlet for expelling the medium;

a central portion between said inlet and outlet for guiding said medium through the apparatus;

one or more negatively charged electrodes located in said central portion;

one or more positively charged collector electrodes located in said central portion for attracting particles having a net negative charge from the medium;

an energy source means connected to said negative charged electrodes for producing a supply of negative ions which bombard particles and cause the particles to be attracted to the positively charged collector electrodes;

each of said collector electrodes having a layer of insulation material attached to and covering a substantial length of said collector electrodes and which has a triboelectric ranking that is greater than the dust particles which are to be collected, said collector structure insulation layer having an electrical relaxation time that is greater than the relaxation time of the space near collector electrodes and the product of resistivity and thickness of said insulation not exceeding a value whereby the voltage drop across the insulating material exceeds about 10% of the applied voltage between the oppositely charged electrodes of said apparatus, respective relaxation times of said insulating material and of space being the product of the electrical resistivity and permittivity thereof.

26. Apparatus as defined in claim 25 wherein said layer has a thickness within the range of about 1/32 inch to about 1/16 inch.

27. Apparatus as defined in claim 26 wherein said layer of insulated material comprises Zirconia.

28. Apparatus as defined in claim 25 including a grid structure attached in an overlying position to said insulating material and means for controlling the voltage level of said grid structure.

29. Apparatus as defined in claim 28 wherein said grid structure comprises a bronze screen.

30. Apparatus as defined in claim 28 wherein said grid structure comprises a copper screen.

31. Apparatus as defined in claim 28 wherein said means for controlling said potential comprises a variable resistor interconnected between said grid and ground potential connection.

* * * * *

UNITED STATES PATENT AND TRADEMARK OFFICE

CERTIFICATE OF CORRECTION

PATENT NO. : 4,077,782

DATED : March 7, 1978

INVENTOR(S) : Drummond, et al

It is certified that error appears in the above-identified patent and that said Letters Patent are hereby corrected as shown below:

| | |
|---|---|
| Column 1, line 67 | "uniformly" should be --uniformity--. |
| Column 4, line 12 | "through" should be --though--. |
| Column 5, line 3 (Table I) | "saran" should be --Saran--. |
| Column 8, line 56 (Claim 8) | "precipitate" should be --precipitator--. |
| Column 8, line 58 (Claim 9) | "precipitate" should be --precipitator--. |
| Column 9, line 19 (Claim 11) | "precipitate" should be --precipitator--. |
| Column 9, line 55 (Claim 17) | "electrods" should be --electrodes--. |
| Column 10, line 43 (Claim 25) | After "near" insert --the--. |

Signed and Sealed this

*Twenty-ninth* Day of *January 1980*

[SEAL]

*Attest:*

SIDNEY A. DIAMOND

*Attesting Officer*

*Commissioner of Patents and Trademarks*